US012201178B2

(12) United States Patent
Siegismund et al.

(10) Patent No.: US 12,201,178 B2
(45) **Date of Patent: *Jan. 21, 2025**

(54) SHOE, ESPECIALLY SPORTS SHOE

(71) Applicant: PUMA SE, Herzogenaurach (DE)

(72) Inventors: Andreas Siegismund, Rückersdorf (DE); Romain Girard, Lauf (DE)

(73) Assignee: PUMA SE, Herzogenaurach (DE)

( * ) Notice: Subject to any disclaimer, the term of this patent is extended or adjusted under 35 U.S.C. 154(b) by 191 days.

This patent is subject to a terminal disclaimer.

(21) Appl. No.: 17/036,831

(22) Filed: Sep. 29, 2020

(65) Prior Publication Data

US 2021/0007443 A1 Jan. 14, 2021

Related U.S. Application Data

(63) Continuation of application No. 16/619,764, filed as application No. PCT/EP2017/000750 on Jun. 27, 2017, now Pat. No. 12,016,430.

(51) Int. Cl.

| | |
|---|---|
| ***A43B 1/04*** | (2022.01) |
| ***A43B 1/028*** | (2022.01) |
| ***A43B 23/02*** | (2006.01) |
| ***A43C 1/04*** | (2006.01) |

(52) U.S. Cl.

CPC ..... *A43B 1/04* (2013.01); *A43B 1/028* (2022.01); *A43B 23/0215* (2013.01); *A43B 23/0245* (2013.01); *A43C 1/04* (2013.01)

(58) Field of Classification Search

CPC ..... A43B 1/04; A43C 5/00
USPC ..... 36/115
See application file for complete search history.

(56) References Cited

U.S. PATENT DOCUMENTS

| | | | | |
|---|---|---|---|---|
| 1,416,203 A * | 5/1922 | Hobson | ..... | A43C 5/00 24/713.2 |
| 1,538,454 A * | 5/1925 | Trawinski | ..... | A43C 5/00 24/714.6 |
| D132,196 S | 4/1942 | Daniels | | |
| D132,197 S | 4/1942 | Daniels | | |
| 2,675,631 A | 4/1954 | Carr | | |
| 2,679,117 A | 5/1954 | Reed | | |

(Continued)

FOREIGN PATENT DOCUMENTS

| | | |
|---|---|---|
| CN | 1143310 A | 2/1997 |
| CN | 101267752 A | 9/2008 |

(Continued)

OTHER PUBLICATIONS

International Search Report and Written Opinion for PCT/EP2017/000750, mailed Mar. 14, 2018.

(Continued)

*Primary Examiner* — Grace Huang
(74) *Attorney, Agent, or Firm* — Quarles & Brady LLP

(57) ABSTRACT

The invention relates to a shoe, especially to a sports shoe, having a shoe upper. The shoe upper consists at least partially of a knitted fabric. The shoe upper has a plurality of loops for threading a lace to allow the tying of the shoe at the foot of a wearer by means of the lace. To provide an easy and efficient method for adjusting the lacing or tying of the shoe at the foot of the wearer individually, at least a part of the loops consist of a knitted fabric. The loops have the shape of a tubular body which forms a passage for the lace.

15 Claims, 3 Drawing Sheets

(56) References Cited

U.S. PATENT DOCUMENTS

| | | | | |
|---|---|---|---|---|
| 4,200,998 | A | 5/1980 | Adams | |
| 6,240,657 | B1 * | 6/2001 | Weber | A43C 5/00 24/714.8 |
| 6,286,233 | B1 | 9/2001 | Gaither | |
| 6,952,890 | B1 | 10/2005 | Blakeslee | |
| 7,073,279 | B2 | 7/2006 | Min | |
| D541,516 | S | 5/2007 | Lane, III | |
| 7,272,897 | B2 | 9/2007 | Yu | |
| D563,657 | S | 3/2008 | Matis et al. | |
| D574,136 | S | 8/2008 | Avar | |
| 7,743,476 | B2 | 6/2010 | Rock et al. | |
| 7,774,956 | B2 | 8/2010 | Dua et al. | |
| D648,110 | S | 11/2011 | Rasmussen | |
| 8,161,666 | B2 | 4/2012 | Liles | |
| D667,621 | S | 9/2012 | Portzline | |
| D689,684 | S | 9/2013 | McMillan | |
| 8,657,773 | B2 * | 2/2014 | Ostergard | A43C 5/00 36/89 |
| 8,661,711 | B2 | 3/2014 | Settele | |
| D718,036 | S | 11/2014 | McMillan | |
| 8,875,418 | B2 * | 11/2014 | Long | A43B 23/0265 36/50.1 |
| 8,881,430 | B2 | 11/2014 | Seamarks et al. | |
| 8,950,088 | B2 | 2/2015 | Aveni et al. | |
| 9,113,674 | B2 * | 8/2015 | Dojan | A43B 23/0235 |
| D740,538 | S | 10/2015 | Roulo | |
| 9,192,204 | B1 | 11/2015 | Liles et al. | |
| D746,558 | S | 1/2016 | Campbell et al. | |
| D756,621 | S | 5/2016 | Weddle | |
| D768,977 | S | 10/2016 | Seamarks et al. | |
| 9,498,023 | B2 * | 11/2016 | Craig | A43B 23/0245 |
| 9,510,637 | B2 | 12/2016 | Podhajny et al. | |
| 9,532,626 | B2 * | 1/2017 | Lovett | A43C 11/20 |
| 9,700,101 | B2 * | 7/2017 | Lovett | F16G 11/02 |
| 9,737,117 | B2 * | 8/2017 | Nonogawa | A43C 1/006 |
| D814,776 | S | 4/2018 | Odinot | |
| D815,413 | S | 4/2018 | Weddle | |
| 9,936,757 | B2 * | 4/2018 | Podhajny | A43B 23/042 |
| 10,039,341 | B2 | 8/2018 | Faucher et al. | |
| 10,051,918 | B2 | 8/2018 | Dombrow et al. | |
| D829,425 | S | 10/2018 | Albrecht et al. | |
| 10,194,714 | B2 * | 2/2019 | McGinnity | A43B 23/027 |
| D846,256 | S | 4/2019 | Khalife | |
| 10,251,448 | B2 * | 4/2019 | Klug | A43B 1/04 |
| 10,316,441 | B2 * | 6/2019 | Ly | D04B 1/123 |
| 10,327,511 | B2 * | 6/2019 | Boys | D04B 1/104 |
| 10,492,566 | B2 | 12/2019 | Guest | |
| 10,499,709 | B2 * | 12/2019 | Pollack | A43C 11/004 |
| 10,694,817 | B2 | 6/2020 | McGinnity et al. | |
| 10,702,017 | B2 * | 7/2020 | Taylor | A43B 13/223 |
| 10,743,618 | B2 | 8/2020 | Bruce et al. | |
| 10,765,173 | B2 * | 9/2020 | Wilson | A43C 1/04 |
| 10,786,035 | B2 | 9/2020 | Howe | |
| 10,806,210 | B2 | 10/2020 | Bruce et al. | |
| 10,844,526 | B2 * | 11/2020 | Brinkman | A43B 23/0265 |
| 10,856,619 | B2 | 12/2020 | Fuerst, Sr. | |
| 10,905,197 | B2 | 2/2021 | Lee et al. | |
| 10,918,155 | B2 * | 2/2021 | Dekovic | A43B 23/02 |
| D911,678 | S | 3/2021 | Petrie et al. | |
| 10,945,482 | B2 | 3/2021 | Schoppel et al. | |
| D932,762 | S | 10/2021 | Vella | |
| 2004/0181972 | A1 | 9/2004 | Csorba | |
| 2006/0059715 | A1 | 3/2006 | Aveni | |
| 2006/0283042 | A1 | 12/2006 | Greene et al. | |
| 2007/0180730 | A1 | 8/2007 | Greene et al. | |
| 2008/0110048 | A1 | 5/2008 | Bhupesh et al. | |
| 2009/0056384 | A1 | 3/2009 | Sayer et al. | |
| 2010/0154256 | A1 | 6/2010 | Dua | |
| 2012/0246897 | A1 | 10/2012 | Lee | |
| 2012/0255201 | A1 * | 10/2012 | Little | A43D 111/00 12/142 R |
| 2015/0059209 | A1 | 3/2015 | Dekovic et al. | |
| 2015/0289592 | A1 | 10/2015 | Song | |
| 2015/0359290 | A1 | 12/2015 | Podhajny et al. | |
| 2016/0255913 | A1 | 9/2016 | Uchikawa et al. | |
| 2016/0302524 | A1 | 10/2016 | Smith | |
| 2016/0302527 | A1 | 10/2016 | Meir | |
| 2016/0324269 | A1 | 11/2016 | Dombrow et al. | |
| 2016/0345675 | A1 | 12/2016 | Bruce et al. | |
| 2016/0345677 | A1 | 12/2016 | Bruce et al. | |
| 2016/0360828 | A1 | 12/2016 | Guyan | |
| 2017/0006965 | A1 | 1/2017 | Musho et al. | |
| 2017/0035149 | A1 | 2/2017 | Bruce et al. | |
| 2017/0049187 | A1 | 2/2017 | Aristizabal et al. | |
| 2017/0071290 | A1 | 3/2017 | Follet et al. | |
| 2017/0071291 | A1 | 3/2017 | Follet et al. | |
| 2018/0035759 | A1 | 2/2018 | Pollack et al. | |
| 2018/0042333 | A1 | 2/2018 | Manos-Gully et al. | |
| 2018/0103714 | A1 | 4/2018 | Howe | |
| 2018/0135213 | A1 | 5/2018 | Bell et al. | |
| 2018/0255875 | A1 | 9/2018 | Mcginnity et al. | |
| 2018/0255876 | A1 | 9/2018 | Mcginnity et al. | |
| 2018/0332920 | A1 * | 11/2018 | Burch | A43B 23/0215 |
| 2018/0368506 | A1 | 12/2018 | Bruce et al. | |
| 2019/0037966 | A1 | 2/2019 | Aceves Tinajero et al. | |
| 2019/0116914 | A1 | 4/2019 | Schoppel et al. | |
| 2019/0223541 | A1 | 7/2019 | Aceves Tinajero et al. | |
| 2019/0328075 | A1 | 10/2019 | Poulsen et al. | |
| 2020/0022447 | A1 | 1/2020 | Durrell et al. | |
| 2020/0046078 | A1 * | 2/2020 | Durrell | A43B 1/04 |
| 2020/0048800 | A1 | 2/2020 | McFarland et al. | |
| 2020/0281302 | A1 * | 9/2020 | Hipp | A43B 23/0235 |
| 2020/0390185 | A1 | 12/2020 | Howe | |
| 2021/0007443 | A1 * | 1/2021 | Siegismund | A43B 23/0215 |
| 2021/0052039 | A1 | 2/2021 | Johnson et al. | |
| 2021/0076776 | A1 * | 3/2021 | Siegismund | A43C 1/04 |
| 2021/0186156 | A1 * | 6/2021 | Pogl | D04B 1/22 |
| 2021/0368945 | A1 * | 12/2021 | Bell | A43C 11/1493 |
| 2021/0378362 | A1 | 12/2021 | Reis | |

FOREIGN PATENT DOCUMENTS

| | | | | |
|---|---|---|---|---|
| CN | 102497792 | A | 6/2012 | |
| CN | 103517647 | A | 1/2014 | |
| CN | 203633581 | U | 6/2014 | |
| CN | 203748765 | U | 8/2014 | |
| CN | 205682613 | U | 11/2016 | |
| CN | 206182490 | U | 5/2017 | |
| CN | 108125314 | A | 6/2018 | |
| EP | 1219195 | A1 | 7/2002 | |
| EP | 1219196 | A1 | 7/2002 | |
| EP | 3114951 | A1 | 1/2017 | |
| EP | 3138431 | A1 | 3/2017 | |
| FR | 389990 | A * | 9/1908 | A43C 5/00 |
| FR | 471635 | A * | 11/1914 | A43C 5/00 |
| GB | 190907001 | A * | 10/1909 | A43C 5/00 |
| JP | 2005046520 | A | 2/2005 | |
| WO | 2020033794 | A1 | 2/2020 | |

OTHER PUBLICATIONS

U.S. Appl. No. 62/263,916, filed Dec. 7, 2015; Guest et al; U.S. Pat. No. 10,492,566 (Year: 2015).

* cited by examiner

SHOE, ESPECIALLY SPORTS SHOE

CROSS REFERENCE TO RELATED APPLICATIONS

This application is a continuation of U.S. patent application Ser. No. 16/619,764 filed Dec. 5, 2019; which is a U.S. National Stage application, filed pursuant to 35 U.S.C. § 371, of international application no. PCT/EP2017/000750, filed on Jun. 27, 2017.

BACKGROUND

The invention relates to a shoe, especially to a sports shoe, comprising a shoe upper, wherein the shoe upper consists at least partially of a knitted fabric, wherein the shoe upper has a plurality of loops for threading a lace to allow the tying of the shoe at the foot of a wearer by means of the lace, wherein the loops are a physical structure that define a plurality of channels, the channels being the negative space defined by the loops, and wherein the term "tunnel" refers to both the physical structure of the loop and the negative space of the channel, and wherein at least a part of the loops consist of a knitted fabric, wherein the loops have the shape of a tubular body which forms a passage for the lace.

Usual lacing devices of shoes, especially of sports shoes, have loops which are arranged at a tying strip which is connected with the shoe upper or is part of the same. The loops are arranged near the tongue of the shoe.

Thus, the ability of the shoe to adapt the lacing or tying to an individual shape of the foot of the wearer is limited. Individual demands can normally not be fulfilled. This can lead to a loose fit of the shoe or to pressure marks at the foot of the wearer.

A shoe of the generic kind is shown in EP 3 114 951 A1. Similar solutions are disclosed in US 2016/0302524 A1 and US 2008/0110048 A1.

SUMMARY

It is an object of the present invention to propose a shoe, especially a sports shoe, which provides an easy and efficient possibility to adjust the lacing or tying of the shoe at the foot of the wearer very individually.

The solution of this object according to the invention is characterized in that the knitted fabric of the shoe upper and the knitted fabric of the loops form a unitary knit construction, wherein the loops are connected with the knitted fabric of the shoe upper only by the knitted construction and are free from any means for transferring a tying force (like for example tensile strands which are arranged on or in the shoe upper).

At least a part of the loops can have an outer diameter and an inner diameter to form the tubular body for receiving the lace, wherein the tubular body has a length, wherein the length is at least 100% of the outer diameter. Preferably, the length is at least 150%, specifically at least 200%, of the outer diameter. Each loop consists of a plurality of knitted rows of yarn.

The tubular body of the loops and channels can have an axial direction, wherein the axial direction is oriented in the longitudinal direction of the shoe or draws an angle to the longitudinal direction below 30°, preferably below 25°. The longitudinal direction of the shoe is defined by a longitudinal plane that is parallel with respect to a resting surface when the shoe is resting on the resting surface. But this orientation of the loops is not mandatory. It is also possible to orient the loops under another angle up to 90° to the longitudinal direction (i.e. perpendicular to the longitudinal direction).

Preferably a number of loops is arranged in such a manner that the loops have the same axial direction.

The loops are preferably distanced from another by a distance, measured perpendicular to the axial direction, wherein the distance is between 2 mm and 25 mm.

The knitted fabric of the shoe upper can form a single layer which bears the loops.

An alternative embodiment provides that the knitted fabric of the shoe upper has at least two layers, wherein the upper layer bears the loops. In this case it can be provided that the layer below the upper layer is connected with the upper layer but has no contact with the loops.

According to a preferred embodiment of the invention the yarn of the shoe upper can consist of or comprise polyester or polyamide. Also, the yarn of the loops can consist of or comprise polyester or polyamide. Of course, also other kinds of yarn are suitable.

The yarns of the shoe upper and of the loops can be different in at least one (physical) property. Specifically, the yarns of the shoe upper and of the loops can have different colors. Of course, it is also possible to use the same yarn for the shoe upper and the loops.

By the proposed concept it is possible to provide a plurality of loops for threading of the lace which can be selected according to individual demands. The loops for the lace are distributed along a quite large area of the shoe upper so that the user can select the required loops according to his or her individual demands. So the lacing or tying of the shoe can be adapted perfectly not only to the shape of the foot of the wearer; it is also possible to take specific demands in consideration which depend on the type of sports and specific training situations.

It is also possible for specific types of sport or training situations to tie the shoe at the foot of the wearer to fix the shoe specifically for lateral or forward movements or to give more hold in the heel region.

Also with respect to this aspect the proposed shoe has advantages compared with pre-known solutions.

Thus, a knitted section of the shoe upper—which is relevant for tying the shoe at the foot of the wearer—is supplied at the outer surface with a plurality of loops or channels (tunnels) which are designed and dimensioned for defining a passage for a lace. The loops are made in such a manner that they are firmly connected with the knitted fabric to avoid pulling out the loops from the knitted fabric below.

A double layer knitted fabric (Double Jersey) is preferred, wherein the loops step out from the upper layer. The bottom layer is flat and ensures the stability of the whole fabric. Also a knitted fabric as a single layer (Single Jersey) is possible which then bears the plurality of loops (tubes, channels or tunnels).

The shoe upper can consist completely of the knitted fabric.

The knitted tubular body which forms the loops can be produced with well-known methods so that a specific description is not necessary here. Reference is made to the so-called Ottoman Stitch which allows the knitting of the loops on a respective knitting machine.

It was found that the knitted base material (made preferably from polyester or polyamide) as well as the number of filaments in the knitting yarn define the tensile strength. Also the length of the loops (channels, tubes) has a respective influence with respect to the stability. Accordingly, it can be taken in consideration to enlarge the length of the loops in the case of types of sports where specific high forces must be expected.

With regard to the knitting technique it should be mentioned that a preferred method is knitting the shoe upper from the right to the left side (i. e. from the lateral side to the medial side of the shoe upper (or vise versa); normally, the shoe upper is knitted from the shoe tip to the heel (or vice versa).

BRIEF DESCRIPTION OF THE DRAWINGS

In the drawings embodiments of the invention are shown.

DETAILED DESCRIPTION

Figure 1:
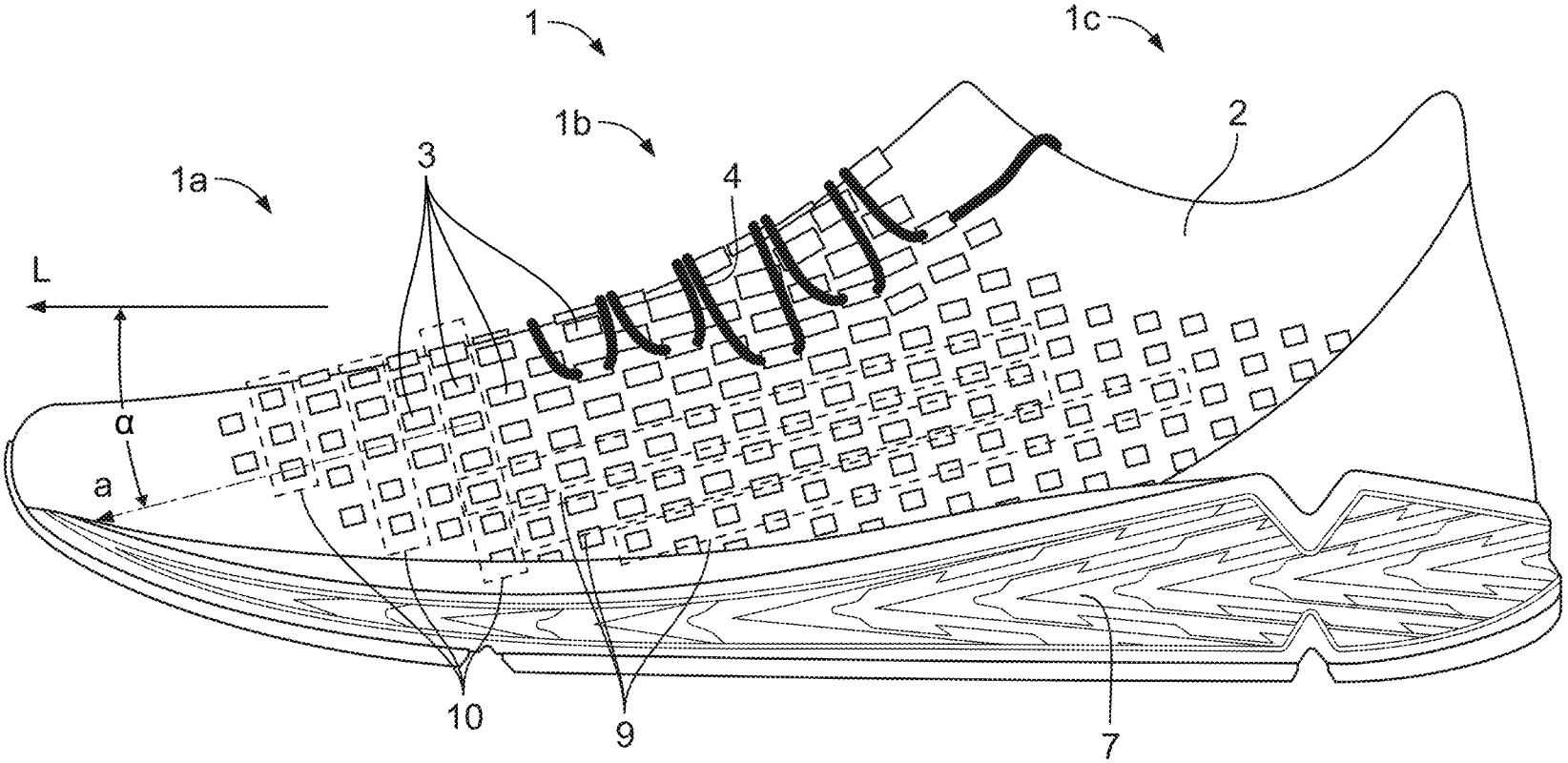
FIG. 1 shows a side view of a sports shoe.

In FIG. 1 a shoe 1 is shown which is a sports shoe. The shoe 1 has a shoe upper 2 and a sole structure 7 which is connected with the shoe upper 2. The shoe 1 has a lateral side, which would be proximate to the outer edge of the foot of a wearer and a medial side, which would be proximate to the inner edge of the foot of a wearer. In the present case the shoe upper 2 consists completely from a knitted fabric. A specific design is provided to allow an individual tying of the shoe at the foot of a wearer.

As can be seen from FIG. 1 a plurality of loops 3 are arranged at and extend from the outer surface defined by a knitted layer of the shoe upper 2. At least some of the plurality of loops are disposed in a plurality of rows 9 and a plurality of columns 10 along the upper. Each of the columns 10 includes a subset of first loops arranged in a column, and each of the rows 9 includes a subset of second loops that are arranged in a row. Intersection loops 12 (see FIGS. 2-5) are shown, which are defined as a single loop within a third subset of loops. FIG. 1 illustrates a plurality of the columns 10 and a plurality of the rows 9. At least some of the plurality of loops 3 can define a first plurality of loops that each define a first channel. Additionally, at least some of the plurality of loops 3 can define a second plurality of loops that each define a second channel. At least part of the loops 3 comprises a knitted fabric and form a unitary knitted construction together with the knitted layer of the shoe upper 2.

Each loop 3 is designed as a tubular body which could also be defined as channel or tunnel and is arranged for threading a lace 4. Thus, each loop 3 forms a passage 8 for the lace 4 (see FIGS. 2 and 4). Each of the channels includes a lower portion 13 of the channel that is disposed entirely below adjacent portions of the outer surface and an upper portion 14 of the channel that is disposed entirely above adjacent portions of the outer surface.

As can be also seen from FIG. 1, the shoe 1 includes a forefoot region 1*a*, a midfoot region 1*b*, and a heel region 1*c*. Further, the plurality of loops 3 are distributed at the outer side of the shoe upper 2 according to a specific pattern: A number of loops 3, which can define a first channel, a second channel, a third channel, a fourth channel, a fifth channel, a sixth channel, a seventh channel, an eighth channel, a ninth channel, a tenth channel, an eleventh channel, and/or a twelfth channel, is arranged in line along their axial direction "a". From FIG. 1 it becomes apparent that loops (channels) arranged in line along their axial direction "a" can define a row. For example, the first channel and the second channel may be coaxial and define a first channel row, the third channel and the fourth channel may be coaxial and define a second channel row, the fifth channel and sixth channels may similarly define a third channel row, and so on. From FIGS. 1-5 it becomes apparent that a channel row may also comprise three or more channels. A number of such sets of loops 3 are arranged on the lateral side of the upper 2 of the shoe 1 with a certain distance perpendicular to the mentioned axial direction "a" (details see FIGS. 2 and 3), and define a subset of first loops of the plurality of loops 3 ("first loops") that are parallel to one another but separated by a distance measured perpendicular to the mentioned axial direction "a", and are thus parallel to one another but not coaxial (i.e. are arranged in the columns 10). From FIGS. 1-5 it becomes apparent that at least two of loops 3, or at least three of loops 3, or more than three of loops 3, can define a set of first loops. The axial direction "a" extends from a heel end toward a toe end of the upper 2.

That is, a plurality of possibilities is given for threading the lace 4 through respective loops 3 so that the shoe 1 can be tied according to individual demands at the foot of the wearer. From FIGS. 1-5 it becomes apparent that a lace can be threaded through at least one of the first, second, third, and fourth channel rows. From FIGS. 1-5 it also becomes apparent that the lace may, or may not, be configured for tying of the shoe at a foot of a wearer.

Figure 2:
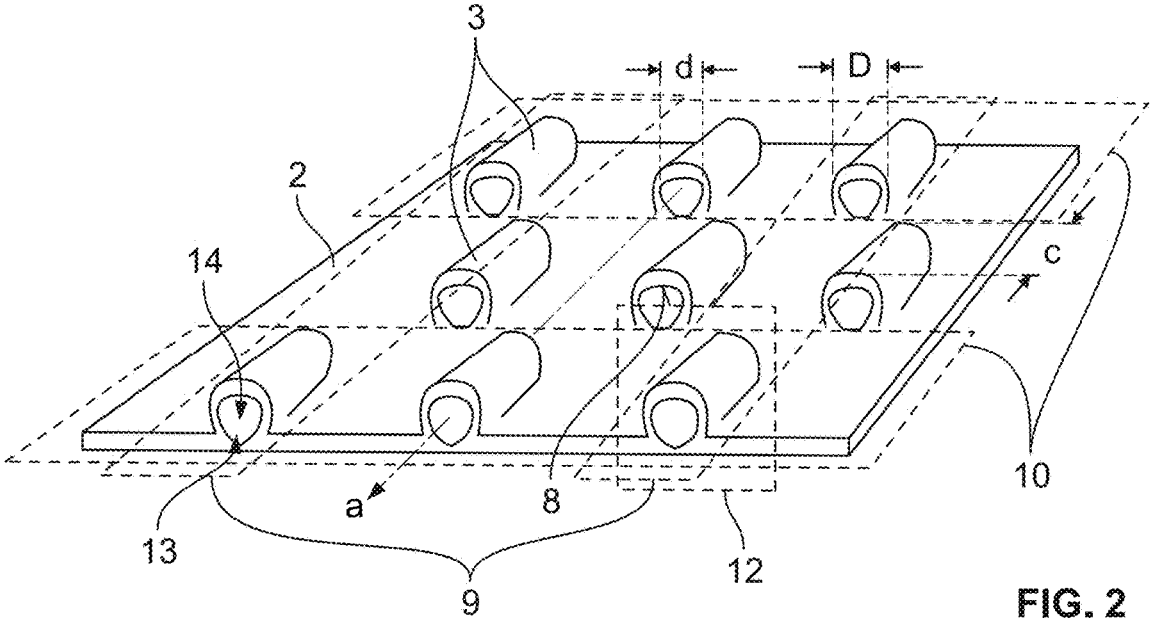
FIG. 2 shows a perspective view of a part of the upper side of a shoe upper according to a first embodiment of the invention.
Figure 3:
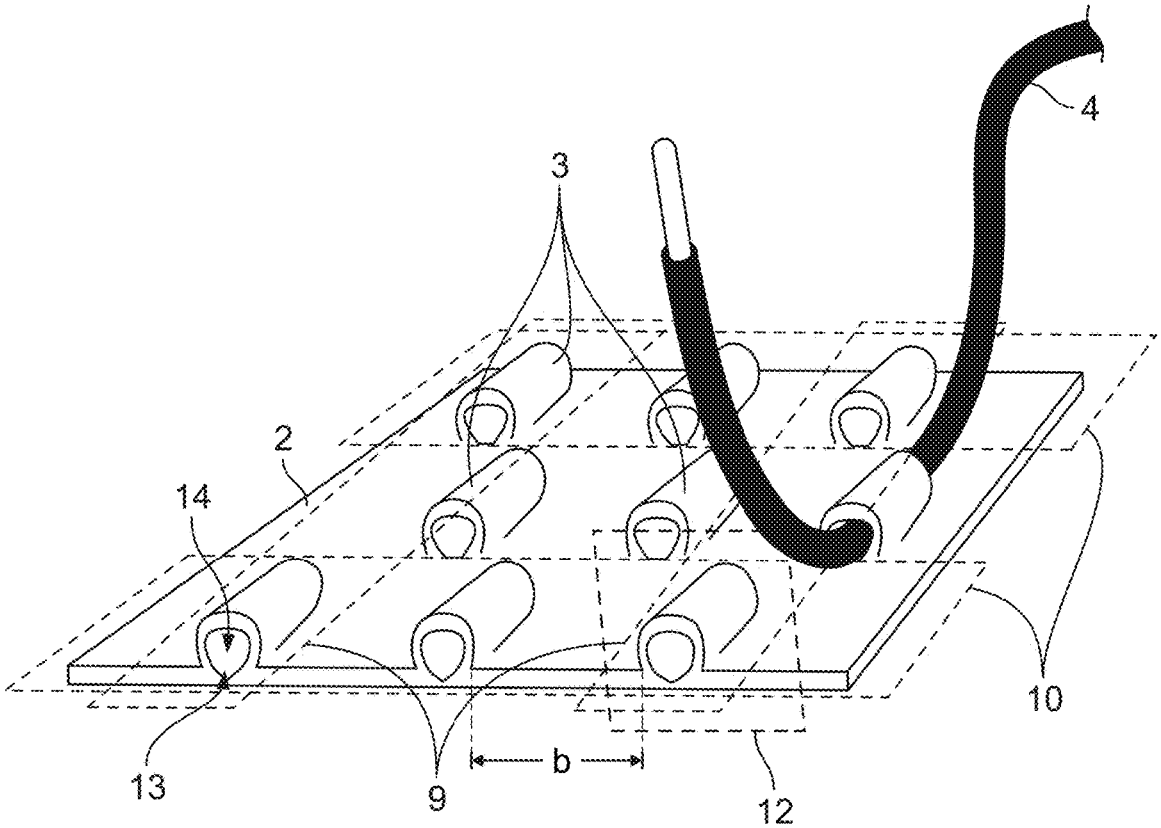
FIG. 3 shows the depiction according to FIG. 2 with a lace being threaded through a loop.

Details concerning the geometry of the loops 3 become apparent from FIGS. 2 and 3. Here, it can be seen that each loop 3 forms a hollow-cylindrical body, i. e. the loop 3 has a tubular shape. Each loop 3 has an outer diameter D and an inner diameter d as well as a length c, which extends in axial direction a of the loop 3.

FIG. 2 illustrates the top surface of the shoe upper 2 without lace 4, while the lace 4 is threaded through a loop 3 in FIG. 3. The knitted fabric of the shoe upper and the knitted fabric of the loops or tubular bodies 3 forms a unitary knit construction. The tubular bodies 3 are connected with the knitted fabric of the shoe upper by the knitted construction, and the plurality of tubular bodies 3 includes a plurality of lateral tubular bodies on a lateral side of the shoe upper and a plurality of medial tubular bodies on a medial side of the shoe upper 2.

From FIG. 2 it becomes apparent that a number of loops 3 can also define a subset of second loops ("second loops") that can be arranged coaxially to one another, i.e. the axial direction a of a number of loops 3, and the axial direction of their respective channels, is identical. Each of the rows 9 of loops comprises a subset of the second loops. From FIGS. 1-5 it becomes apparent that at least two of loops 3, or at least three of loops 3, or more than three of loops 3, can define a subset of second loops. The first plurality of loops are arranged coaxially to form a first row. The second plurality of loops are arranged coaxially to form a second row. A number of those rows 9 of loops 3 can also define a set of "first loops" that is arranged side by side in columns 10, i.e. parallel to one another at a distance b measured perpendicular to the axial direction a, wherein distance b is greater than 0 millimeters. From FIGS. 2-5 it becomes apparent that the first plurality of loops forming the first row and the second plurality of loops forming the second row can be arranged side by side and in parallel with respect to one another. From FIG. 1 it becomes apparent that the first plurality of loops and the second plurality of loops are provided on a lateral side of the upper 2 of shoe 1.

The axial direction a of the loops 3 is substantially oriented in the longitudinal direction L of the shoe 1 (see FIG. 1). That is, the axial direction a draws only a small angle α to the longitudinal direction L which is below 30°, preferably below 25°. This allows an optimal threading of the lace 4 and a good transfer of forces from the loop 3 to the shoe upper 2.

Figure 4:
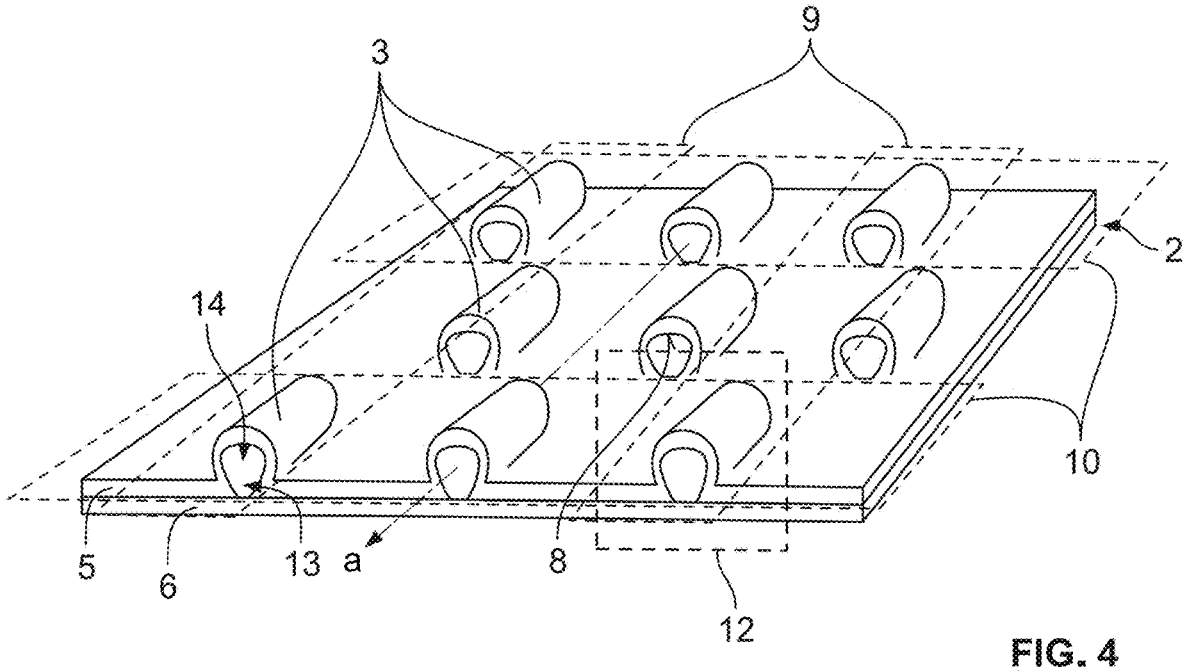
FIG. 4 shows a perspective view of a part of the upper side of a shoe upper according to a second embodiment of the invention and FIG. 5 shows the depiction according to FIG. 4 with a lace being threaded through a loop.
Figure 5:
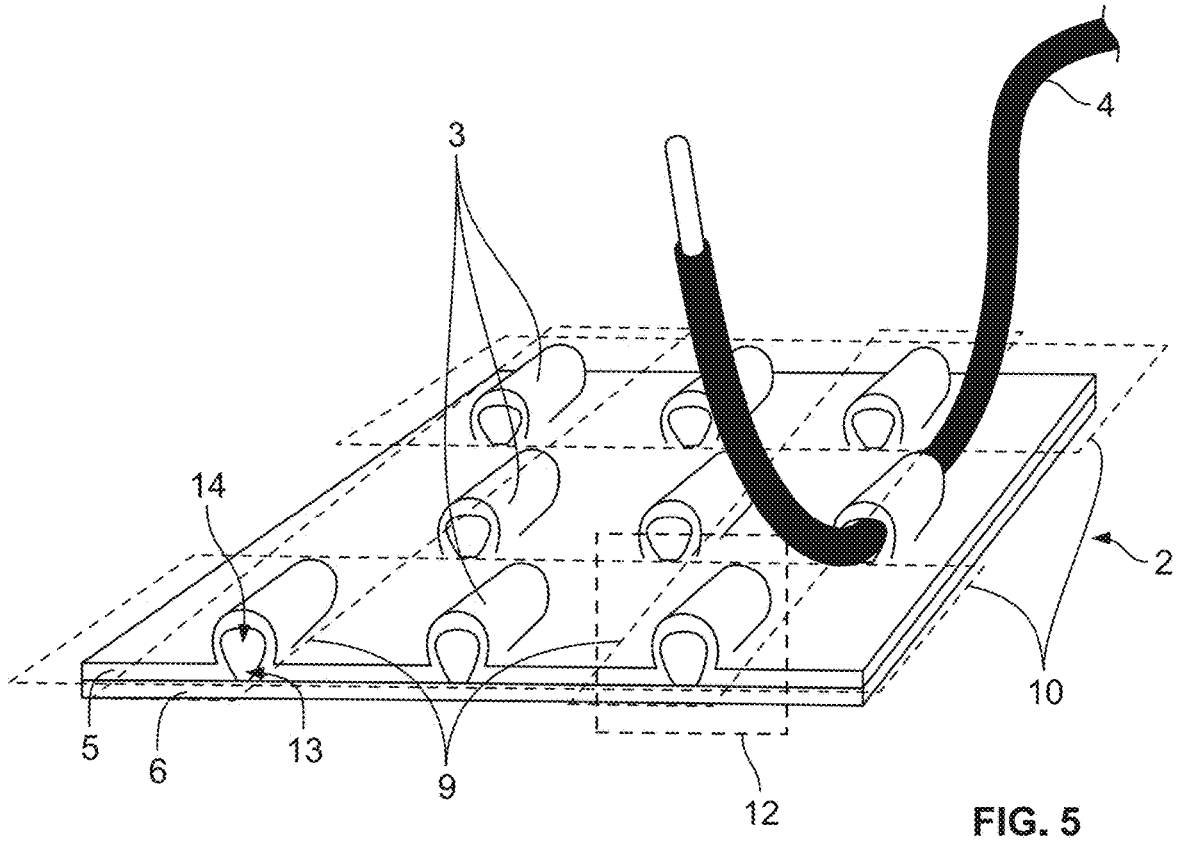

In the embodiment according to FIGS. 2 and 3 the shoe upper 2 has only a single layer of knitted fabric (Single Jersey). In FIGS. 4 and 5 an embodiment is depicted in which the shoe upper 2 consists of two layers 5 and 6, namely of an upper layer 5 of the shoe upper 2 and a bottom layer 6 of the shoe upper 2 (Double Jersey). The loops 3 are formed as a unitary knitted construction with the upper layer 5 while the bottom layer 6 is connected with the upper layer 5 but not with the loops 3.

FIG. 1 shows an embodiment which is substantially on scale with regard to the dimensions of the loops 3. From FIGS. 1-5 it becomes apparent that a number of loops 3 can define another subset of loops, i.e., intersection loops 12 ("third loops") that can be part of the subset of second loops that are arranged coaxially, while also simultaneously being a part of the subset of first loops that are arranged parallel to one another at a distance b. From FIGS. 1-5 it becomes apparent that a plurality of loops 3 can define a subset of third loops.

The whole knitting construction of the shoe upper 2 including the loops 3 can be produced on a knitting machine which is well known as such and allows an economical production of the shoe upper 2.

REFERENCE NUMERALS

1 Shoe
2 Shoe upper
3 Loop
4 Lace
5 Upper layer of the shoe upper
6 Bottom layer of the shoe upper
7 Sole
8 Passage (channel)
9 Row of Loops
10 Column of Loops
11 Tunnel
12 Intersection Loops
13 Lower Portion
14 Upper Portion
D Outer diameter of the loop
d Inner diameter of the loop
c Length of the loop
a Axial direction of the loop
b Distance between the loops
L Longitudinal direction of the shoe
α Angle

We claim:

1. A shoe, having a forefoot region, a heel region, and a midfoot region between the forefoot region and the heel region, the shoe comprising a knitted upper and a sole structure, the upper comprising:

a knitted layer defining an outermost surface of the upper; and a plurality of loops, each of which comprises a channel, the plurality of loops extending from the upper, wherein the plurality of loops are entirely comprised of a knitted fabric, wherein each of the channels is configured to receive a lace, wherein, in a pre-laced configuration, each of the channels includes a lower portion of the channel that is disposed entirely below adjacent portions of the outermost surface and an upper portion of the channel that is disposed entirely above adjacent portions of the outermost surface, wherein the knitted layer and the knitted fabric of the plurality of loops are connected to form a unitary knit construction, wherein some of the plurality of loops are disposed in a first column of loops and a second column of loops that are each disposed entirely within the forefoot region of the shoe, and wherein the first column of loops includes at least two loops of the plurality of loops and the second column of loops includes at least two loops of the plurality of loops.

2. The shoe of claim 1, wherein at least one of the channels defines an outer diameter and an inner diameter for receiving the lace, wherein the at least one channel has a length, wherein the length is at least 100% of the outer diameter.

3. The shoe of claim 2, wherein the length is at least 200% of the outer diameter.

4. The shoe of claim 1, wherein the plurality of loops are disposed in a plurality of rows along the upper.

5. The shoe of claim 1, wherein a longitudinal plane is parallel with respect to a resting surface when the shoe is resting on the resting surface, and wherein the channels comprise axes that each define an angle that is less than 25° offset from the longitudinal plane.

6. The shoe of claim 1, wherein the plurality of loops are arranged such that the loops have the same axial direction.

7. The shoe of claim 1, wherein the knitted layer and the knitted fabric of the plurality of loops form a single knit layer through which the channels are defined.

8. The shoe of claim 1, wherein a yarn of the knitted layer consists of polyester or polyamide.

9. A shoe having a forefoot region, a heel region, and a midfoot region between the forefoot region and the heel region, the shoe comprising a knitted upper and a sole structure, the upper comprising:

a knitted layer defining an outermost surface of the upper; and a plurality of loops, each of which comprises a channel, the plurality of loops extending from the upper;

wherein each of the channels forms a passage for a lace that extends through at least some of the plurality of loops, wherein, in a pre-laced configuration, each of the channels includes a lower portion of the channel that is disposed entirely below adjacent portions of the outermost surface and an upper portion of the channel that is disposed entirely above adjacent portions of the outermost surface, wherein some of the plurality of loops are disposed in at least a first column of loops and a second column of loops, which are disposed along the forefoot region of the shoe, and wherein the plurality of loops are all entirely comprised of a knitted fabric.

10. The shoe of claim 9, wherein the respective channels of at least some of the loops within the first column of loops and the second column of loops are coaxial with respect to one another.

11. The shoe of claim 9, wherein each of the channels extends in a direction from the heel region toward the forefoot region.

12. The shoe of claim 9, wherein the first column of loops includes at least three loops and the second column of loops includes at least three loops.

13. The shoe of claim 10, wherein a yarn of the knitted layer consists of polyester or polyamide.

14. The shoe of claim 9, wherein the knitted layer and the knitted fabric of the plurality of loops are connected to form a unitary knit construction.

15. A shoe, having a forefoot region, a heel region, and a midfoot region between the forefoot region and the heel region, the shoe comprising a knitted upper and a sole structure, the upper comprising:

a knitted layer comprising polyester or polyamide, defining an outermost surface of the upper;

a plurality of loops, each of which comprises a channel, the plurality of loops extending from the upper;

wherein each of the channels forms a passage for a lace that extends through at least some of the plurality of the channels, wherein, in a pre-laced configuration, each of the channels includes a lower portion of the channel that is disposed entirely below adjacent portions of the outermost surface and an upper portion of the channel that is disposed entirely above adjacent portions of the outermost surface, wherein the plurality of loops comprises a plurality of first loops, wherein each of the first loops is arranged such that its channel extends in the same direction as at least one other first loop from which it is separated by a distance B, measured perpendicular to an axial direction of the loops, wherein B is between 2 and 25 millimeters, and wherein the plurality of loops are entirely comprised of a knitted fabric.

* * * * *